United States Patent [19]

Kurosaki

[11] Patent Number: 4,616,861

[45] Date of Patent: Oct. 14, 1986

[54] LOCK DEVICE

[75] Inventor: Mutsuo Kurosaki, Yahata, Japan

[73] Assignee: Nifco, Inc., Yokohama, Japan

[21] Appl. No.: 755,868

[22] Filed: Jul. 17, 1985

[30] Foreign Application Priority Data

Jul. 23, 1984 [JP] Japan ..... 59-151184

[51] Int. Cl.[4] ..... E05C 19/02

[52] U.S. Cl. ..... 292/6; 292/45; 292/129; 292/DIG. 4

[58] Field of Search ..... 292/DIG. 4, DIG. 38, 292/DIG. 72, 5, 6, 45, 129, 170, 179, 191, 192, 198, 229; 24/645, 654, 656, 662

[56] References Cited

U.S. PATENT DOCUMENTS 2,153,077 4/1939 Clarke ..... 24/645
4,270,781 6/1981 Nishimura ..... 292/DIG. 4 X
4,482,175 11/1984 Sugie ..... 292/DIG. 4 X

FOREIGN PATENT DOCUMENTS 60-11977 1/1985 Japan .

*Primary Examiner*—Gary L. Smith
*Assistant Examiner*—Russell W. Illich
*Attorney, Agent, or Firm*—Trexler, Bushnell & Wolters, Ltd.

[57] ABSTRACT

A first push of an engaging piece moves a projecting portion provided on a case along a one-way passage loop provided on one face of a cam plate while simultaneously moving the cam plate transversely, guiding the projecting portion into an engaging portion provided in said passage, locking the device. Pushing the engaging piece a second time disengages the projecting portion from the engaging portion and moves the cam plate transversely back to its original position, unlocking the device.

1 Claim, 19 Drawing Figures

LOCK DEVICE

BACKGROUND OF THE INVENTION

This invention relates to a lock device which can be advantageously used to hold in the closed position doors or the like which are hinge-mounted to be freely openable. This invention relates particularly to a lock device which locks when a pressing means such as an engaging member provided on the door is subjected to a first push and unlocks when subjected to a second push to allow the door to open.

Conventional lock devices are already known and have been put to practical use in which two pushes in the same direction are used, the first push locking the lock and the second push unlocking the lock.

A number of such lock devices have been proposed which are structurally different. Representative of such known lock devices include those which employ a rotating cam plate and those having a heart-shaped groove in which is slidably engaged a springy pin which can only move in one direction.

The former type of lock device is provided with a case and a sliding member which can slide into or out of the case, and which bears the oblong rotating cam plate which is provided with two engaging portions, the length of the rotating cam plate being always aligned with the sliding member, and when a first push causes the sliding member to enter the case, a notch-shaped engaging portion located on the tip of the cam plate contacts a projection provided on the case, causing the cam to turn slightly and an identical notch-shaped engaging portion formed on the rear end to move transversely out of alignment with the sliding member, and when the sliding member is urged back by the force of a spring the engaging portion on the rear end engages with the engaging portion provided on the case, preventing the retraction of the sliding member to put the lock device into a locked state. With a second push, the sliding member enters further into the case, and utilizing this, the engaging portion at the front end again comes into contact with the projection, turning the cam plate slightly and disengaging the rear end engaging portion, enabling the lock to be unlocked. Locking and unlocking is thus done by the two pushes, the construction being such that in between the rotating cam plate is turned through a half revolution.

The latter device consists of a cam plate with a heart-shaped groove and a springy pin which slidably engages in the groove. The floor of the groove is sloped and stepped at several places so as to permit movement in one direction only, and the tip of the pin is moved along while being pressed against the floor of the groove. With the first push the pin moves along the groove and is guided into the valley of the heart shape where it engages to put the lock device into a locked state, while the next push dislodges it from the valley and returns it to its original state, unlocking the lock.

Both types of devices have been put into practical use, but with the former, as just a slight turn of the rotating cam plate enables the engagement of the engaging portion and the locking and unlocking of the lock, a high degree of precision is required with respect to the relative positions of the parts, and, especially when the device was made smaller, the small manufacturing tolerance involved gave rise to malfunctioning. Also with regard to this rotating cam plate type lock device, because its operation did not provide a feeling that it was snapping into place, said operation did not give the user any tactile information, and it therefore was necessary to check visually.

In the case of the latter type of lock device, when the pin being moved along the groove mounted the slopes provided on the floor of the groove and dropped at the steps, the tip of the pin struck the floor with a sharp click as it engaged with the valley of the heart, locking the lock, and when the pin was subsequently dislodged from the base, unlocking the lock, the positive click it gave provided a fully adequate tactile sensation of the operation. However, on the other hand, with the lock device of this conventional heart-shaped groove type, the complexity of the pin action meant also that it was structural complex, and this was a major hindrance, especially with respect to making the device smaller.

Specifically, in the operation of sliding the pin along the heart-shaped groove, the tip of the pin oscillates transversely to follow the heart shape, and this movement has to be accompanied by the sliding contact of the pin tip with the groove floor under a constant spring pressure, and by vertical motion in accordance with the slopes and steps provided in the floor of the groove, so it is necessary for the pin to be of a material with good resistance to deformation, such as steel wire, and it was also necessary to provide the device with another means to exert the spring-pressure on the floor of the groove, which was troublesome in terms of the relationship of the parts in the assembly and also meant more parts, which naturally hindered any downsizing of the device.

SUMMARY OF THE INVENTION

The present invention is the result of research and development carried out with regard to the defects in the conventional lock devices as described in the above. The object of the present invention is to provide a lock device that has a highly precise action and low risk of malfunction or breakage. Another object is to provide a lock device that is easy to manufacture and can be made smaller.

Whereas in the above conventional lock device the single springy pin has to be subjected to a transverse oscillating movement as the pin follows the heart shape and the vertical movement produced by the slopes and steps provided along the floor of the heart-shaped groove, in the lock device according to the present invention these motions are separated with a projecting portion provided on the tip of the spring which corresponds to the pin being subjected only to the vertical motion produced as it moves along the floor of the heart-shaped groove, while with respect to the transverse oscillation as the heart-shaped contour is followed, this is handled by forming a separate heart-shaped groove in a cam plate and providing the cam plate so that it can freely move to the left and right, so that two means are employed to separate the two directionally differing motions, thereby reducing each motion to a single plane, while also acting to simplify the means, thus providing a lock device which is easy to manufacture but is highly reliable, and which can easily be made more compact.

BRIEF EXPLANATION OF THE DRAWINGS

Other objects and features of the invention will become clear from a description provided with reference to the following drawings, in which.

DESCRIPTION OF THE PREFERRED EMBODIMENT

Figure 1:
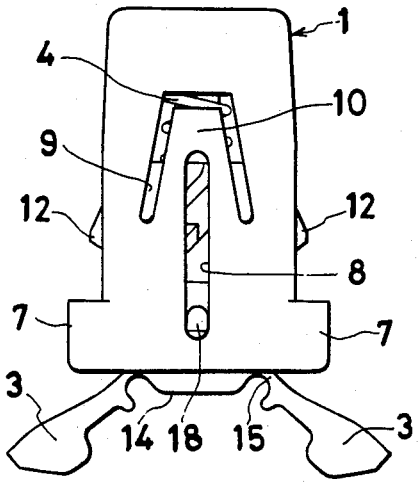
FIG. 1 is a plan view of one embodiment of the lock device according to the present invention.
Figure 2:
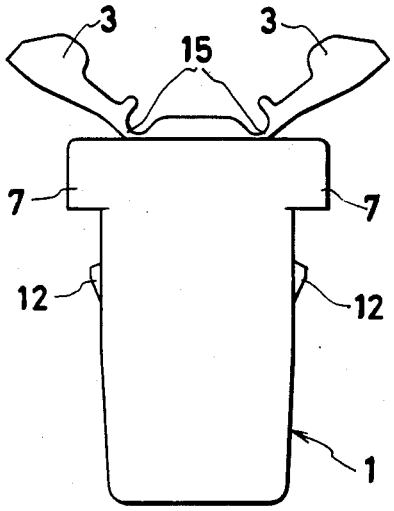
FIG. 2 is a base view of the lock device of FIG. 1.
Figure 3:
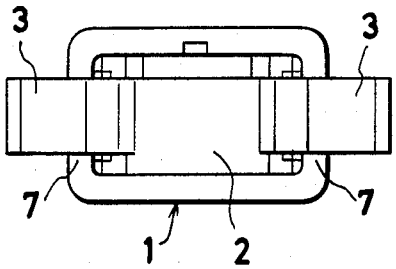
FIG. 3 is a plan view of the lock device of FIG. 1.
Figure 4:
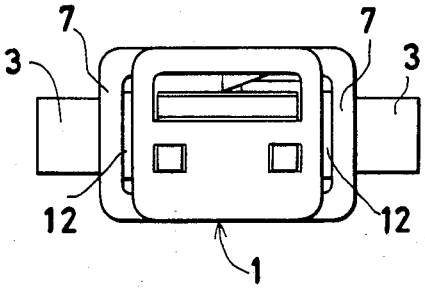
FIG. 4 is a rear view of the lock device of FIG. 1.
Figure 5:
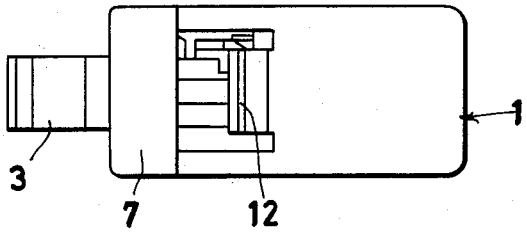
FIG. 5 is a view from the right of the lock device of FIG. 1.
Figure 6:
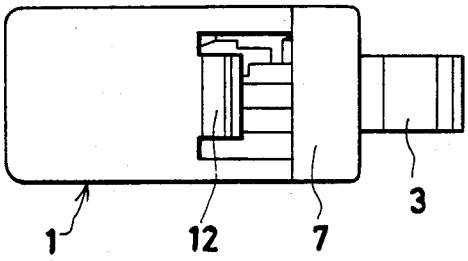
FIG. 6 is a view from the left of the lock device of FIG. 1.
Figure 9:
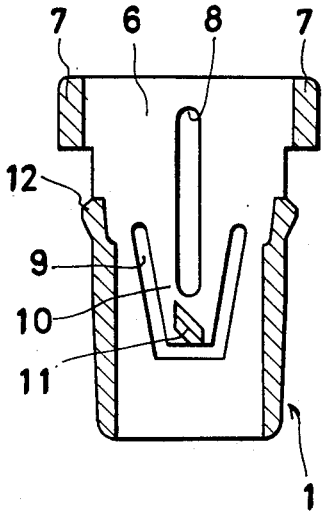
FIG. 9 is a cross-sectional base view of the case of the lock device of FIG. 1.
Figure 7:
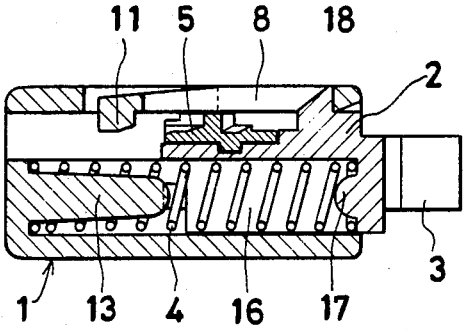
FIG. 7 is a longitudinal cross-section view of the lock device of FIG. 1 in the unlocked state.
Figure 10:
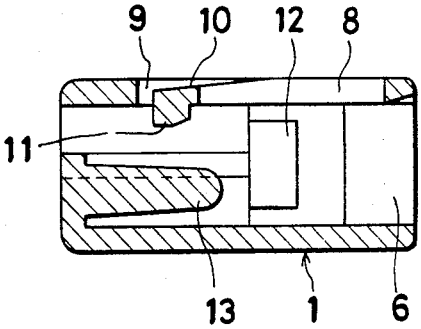
FIG. 10 is a longitudinal cross-section view of the case of FIG. 9, seen from the side.
Figure 8:
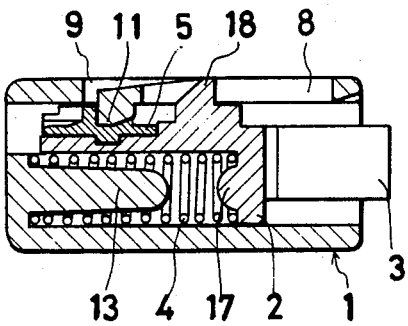
FIG. 8 is a longitudinal cross-section view of lock device of FIG. 1 in the locked state.
Figure 11:
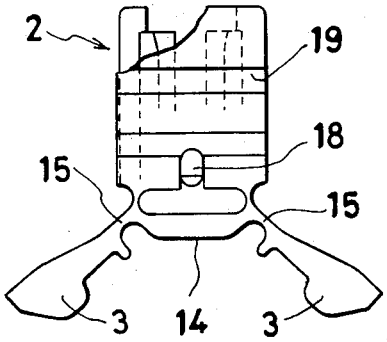
FIG. 11 is a slightly abbreviated plan view of the engaging member of the lock device of FIG. 1.

With reference to the drawings, which show an embodiment of the lock device according to the present invention, the lock device is comprised of: a case 1, an engaging piece 2 having, in this embodiment, a pair of retainers 3 which can slide into the case; a spring 4 which urges the engaging piece in the direction of the case opening; and a cam plate 5 interposed between the case 1 and the engaging piece 2 therein, for regulating the sliding movement of the engaging piece and locking and unlocking of the retainers 3. In the illustrated embodiment, all parts other than the spring 4 are individually formed of a thermoplastic synthetic resin such as nylon resin.

As shown in the drawings, the case 1, which has an opening 6 at one end and is like an extended box in shape, is provided with rims 7 on the exterior surface to the left and right of the opening 6. A centrally-located guide slot 8 extending from a position near the opening 6 towards the back is provided in the top wall thereof. Also provided in the center portion of the top wall is an abbreviated V-shaped recess 9, positioned so that it does not intersect the guide slot 8, and a portion of the wall forming a spring 10 the inner surface of the unattached end of which is provided with a projecting portion 11 which protrudes inward. A portion of each side of the case is cut to protrude out and provide catch portions 12 opposite to the rims 7, while on the inner surface of the rear wall is provided a rod-shaped mounting 13 which projects towards the opening 6 for fitting the spring 4.

The engaging piece 2 is in the form of a block one end of which is the contact end portion 14, the sides of which extend via a thin hinge portion 15 to the opposing retainers 3. The main body of the block is further provided with a hollow portion 16 which in shape is an abbreviated cylinder opening towards the rear of the block and the base of which is provided with an engaging projection 17 for the spring 4. The top surface of the main body is provided with a projection 18 at the center portion thereof near the contact end portion 14, and away from the contact end portion towards the back portion with a straight, transverse guide groove 19.

The cam plate, which is rectangular in shape, is provided on its lower surface with a transverse ridge 20 for sliding engagement with the guide groove 19 provided on the engaging pieces 2, and on the center of its upper surface with an elevated portion 21 which forms an abridged heart shape around the perimeter of which is a passage 22 which follows the heart shape.

Figure 12:
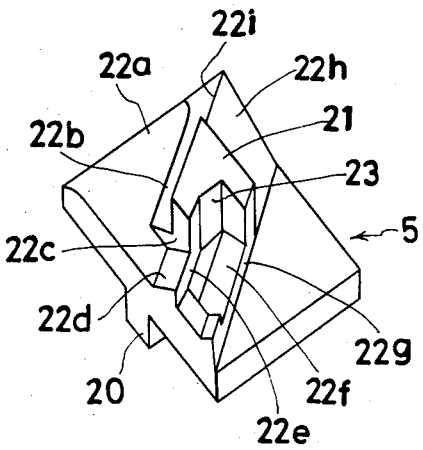
FIG. 12 is an enlarged perspective view of the cam plate of the lock device of FIG. 1.
Figure 13:
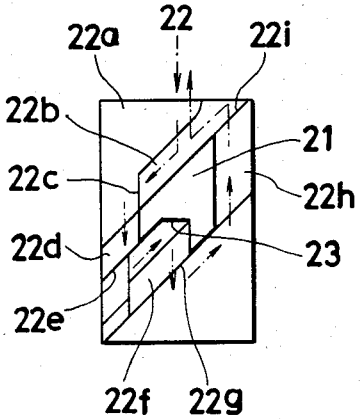
FIG. 13 is a plan view of the cam plate shown in FIG. 12.
Figure 14:
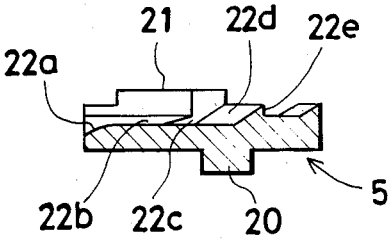
FIG. 14 is a longitudinal cross-section view of the cam plate of FIG. 12, seen from the side.

As will be described below, the projecting portion 11 provided on the end of the spring 10 of the case 1 is slidably engaged in the passage 22, and the guiding thereof in the one direction puts the retainers 3 provided on the engaging pieces 2 into an engaged state or a disengaged state. As shown in detail in FIGS. 12 to 14, with respect to the passage, with the centrally-located elevated portion 21 forming the center, a receivng portion **22*a* which takes the projecting portion 11 continues on to a sloping portion 22*b* provided along one side of the elevated portion 21, and passes the step 22*c* at the end of the sloping portion and goes on to a second sloping portion 22*d*, and from the step 22*e* at the end thereof to the engaging portion 23 which forms the valley of the heart-shaped elevated portion, and thence to a third sloping portion 22*f* and step 22*g*, over a sloping portion 22*h* provided along the side opposite that of the elevated portion 21, past a step 22*i* to arrive back at the receiving portion 22*a*, making one full circuit around the elevated portion 21. The combination of the sloping portions and the steps is such as to enable the projecting portion 11 of the spring 10 to move always in the same direction, the direction indicated by the arrow in FIG. 13, in the process of which it can engage or disengage with the engaging portion 23**.

The cam plate 5 provided with this single-plane passage 22 which loops in the one direction is mounted on the top surface of the engaging piece 2 and in the coupled state is pushed into the opening 6 of the case 1 for assembly into a single device. This state of full assembly is shown in FIGS. 1 through 7.

The assemblage will now be described in further detail. In, as described above, the state of assembly when the engaging piece 2 is mounted on the cam plate 5 and the ridge 20 has engaged with the guide groove 19 of the engaging piece, the coil spring 4 is set into the hollow portion 16 and one end of the spring is set on the engaging projection 17. The cam plate 5 and the engaging piece with the spring is then inserted into the opening 6 of the case 1, and the protruding tip of the spring 4 fitted onto the rod-shaped mounting 13 provided in the case, and in that state the mounting 13 is readied for entry into the hollow portion 16 and the whole of the engaging piece is inserted into the case.

At this point, the projection 18 provided on the upper surface of the engaging piece is contacting the upper surface of the opening 6, and utilizing the resilience of the case material, if forced in, pushing up the upper surface, the projection 18 engages with the guide slot 8 provided on the upper surface of the case and the pushed-up upper surface flexes back, preventing the egress of the engaging piece 2.

Thus, the engaging piece in the case is constantly urged towards the opening 6 by the force of the spring 4 and maintained with the projection 18 in one end of the guide slot 8. At this time the contact end portion 14 is aligned with the opening 6, so the extended retainers 3 are maintained in an open state outside the opening 6.

When the assemblage of the present invention wherein the engaging piece 2 and the cam plate 5 are contained within the case 1 is employed as a door closure means, it is affixed to the opening of a cabinet or the like having hinged doors, the door is held closed by an engaging member provided on the rear side of the opening/closing edge of the door being caught by the opposing retainers 3.

FIGS. 15 to 19 show the use and functioning of the lock device of this invention, and the actual use and functioning will now be described in line with the said drawings.

When this lock device is employed as a door closure means, as described in the foregoing, a through-hole 25 to attach it is made in a panel 24 which forms the opening of the cabinet or the like having a hinged door. The case is inserted into the through-hole from the front and the rims 7 provided at right and left on the outside of the opening 6 fit into an expanded portion inside the through-hole, and with this the catch portions 12 provided at the left and right sides pass right through so that the edge of the opening 6 is held between the rims 7 and the catch portions 12. The engaging member 27 having an expanded engaging portion at its tip is affixed to the rear surface of the free edge of the door 26 opposite the lock device of this invention attached as described above.

Figure 15:
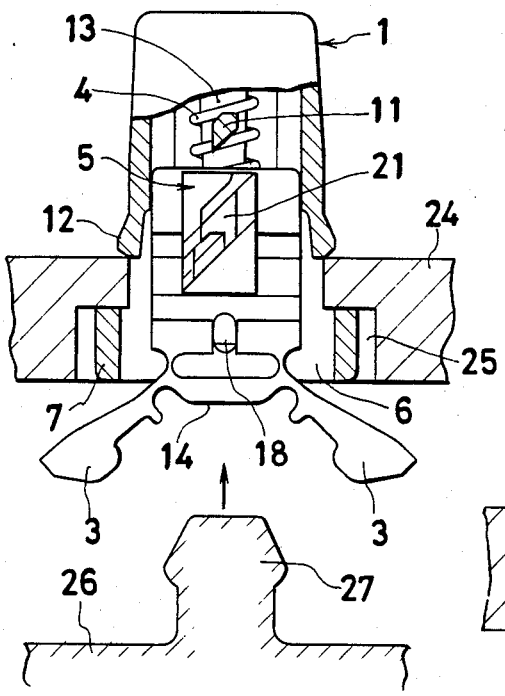
FIG. 15 is an explanatory view of the lock device of FIG. 1 in its unlocked state.

FIG. 15 shows the device thus fixed and also illustrates the device immediately prior to locking, with contact end portion 14 of the engaging piece 2 in alignment with the opening 6 of the case 1 and the retainers 3 extending from the contact end portion opened into a V outside the opening for the insertion of the engaging member 27 thereinto.

In this state, with the operatin of closing the door 26, the engaging member 27 is thrust forward so the tip thereof makes the initial contact with the contact end portion 14 of the engaging piece 2, and as it is pushed the engaging piece compresses the spring 4 as it enters further into the case 1, while at the same time the retainers 3 which had been extended outside the case opening 6 are brought closer together by the contact with the edge of said opening to grip the expanded engaging portion of the engaging member 27.

Figure 16:
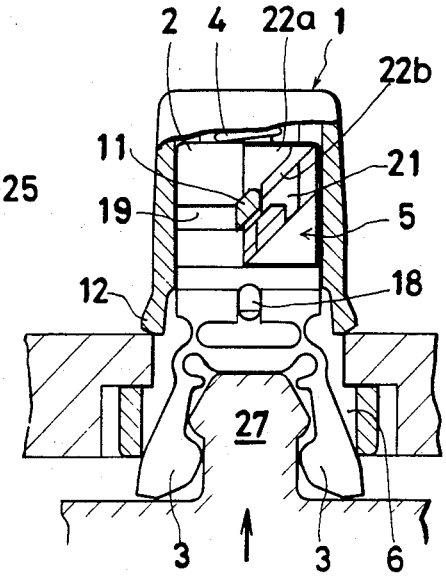
FIG. 16 is an explanatory view of the lock device of FIG. 1 showing the engaging member thereof inserted into the case.

This is illustrated by FIG. 16. With the rearward movemet of the engaging piece 2 the cam plate 5 which has moved onto the upper surface thereof is taken into the inner part of the case, the projecting portion 11 of the spring 10 provided on the top surface of the case reaches the receiving portion 22*a* of the heart-shaped passage 22, and with the entry of the cam plate 5, as the engaging piece is pushed further in, the said projecting portion 11 moves onto the first sloping portion 22*b* and also is moved along one side of the elevated portion 21 to go in deep towards the center part of the cam plate 5.

When the projecting portion 11 moves up onto the sloping portion 22*b* the flexing of the spring 10 enables the projecting portion 11 to rise as it moves along the sloping portion, but because it does not move transversly, when it meets with the inclined side of the elevated portion 21, the cam plate is moved to the right with the ridge 20 which is engaged in the guide groove 19 of the engaging piece acting as a guide, thereby allowing the upward movement of the projecting portion 11. What FIG. 16 actually shows is the state at this time.

Figure 17:
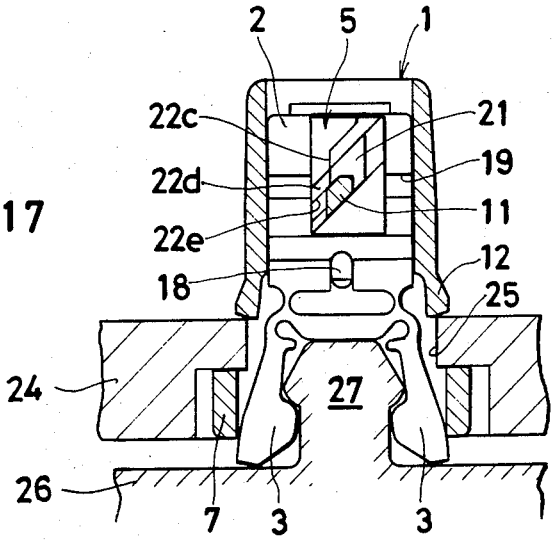
FIG. 17 is an explanatory view of the lock device of FIG. 1 in its locked state.

FIG. 17 shows the state arrived at with the further progress of the pushing, with the retainers 3 completely inside the opening 6, holding the engaging member 27, with the projecting portion 11 in the passage 22 of the cam plate 5 having passed step 22*c*, sloping portion 22*d* and descended the following step 22*e*, following the slope of this stepped portion to engage with the engaging portion 23 which is the valley part of the elevated portion 21.

When the projecting portion 11 has descended at the step 22*e* the engaging piece 2 has reached the deepest part of the case 1 and can go no further. As the pushing in of the engaging piece ceases, the force of the spring 4 urging the projecting portion 11 back guides the projecting portion 11 into the angle formed with step 22*e*, so it automatically engages with the engaging portion 23. Along with this, the cam plate 5, with the guide groove 19 acting as a guide, is again moved transversely to the center part of the top surface of the engaging piece 2.

The state shown by FIG. 17 is when the lock device of this invention is locked, i.e. the door 26 is closed. To release the door, the front of the door is again pushed, pushing the engaging member 27 against the engaging piece 2 and putting the device into a state of disengagement.

Figure 18:
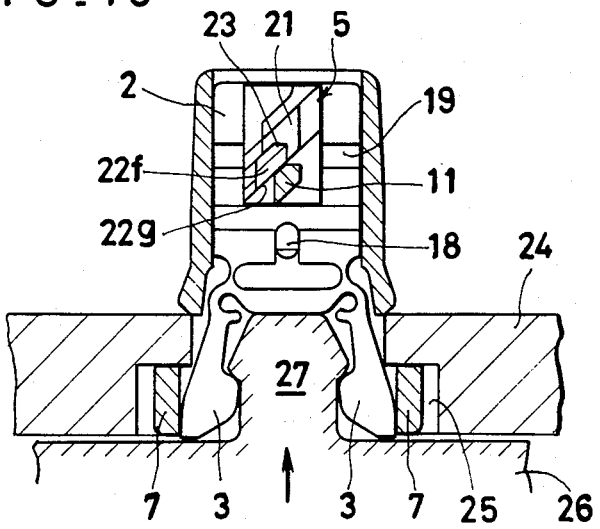
FIG. 18 is an explanatory view of the engaging member of the lock device of FIG. 1 showing when it has been pushed a second time.
Figure 19:
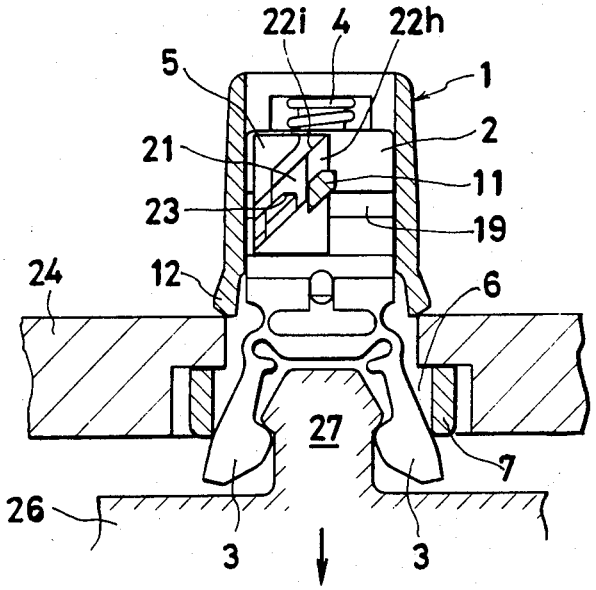
FIG. 19 is an explanatory view of the engaging member of the lock device of FIG. 1 shown in the process of being unlocked.

The state illustrated by FIG. 18 is that when the engaging member 27 is again pushed for disengagement, and FIG. 19 shows when the pushing has been stopped and the projecting portion 11 is on the way out of the cam plate passage 22.

When the engaging member 27 is again pushed for said disengagement, the engaging piece 2 is moved towards the back of the case, causing the projecting portion 11 in engagement with the engaging portion 23 to move up onto the third sloping portion 22*f*, flexing the spring 10 upwards, and descend at step 22*g*. With this descent of the projecting portion 11 the front part of the engaging piece 2 comes into contact with the inner surface of the rear wall of the case and so cannot be pushed any further in. When the pushing pressure on the engaging member 27 is therefore stopped, the spring 4 urges the engaging piece 2 back towards the case opening 6 and the cam plate 5 the ridge 20 of which is in sliding engagement with the guide groove 19 retracts towards the opening, so that the projecting portion 11 is moved to the right of the elevated portion 21 along the step 22*g*, and on leaving this elevated portion moves up onto the sloping portion 22*h* and down at the following step 2*i*, to thereby return to the receiving portion 22*a*.

At this stage, following the descent of projecting portion 11 at step 22*g* (the stage illustrated by FIG. 18) and the release of the pushing pressure, the cam plate 5 is moved to the left, guided by the slope of step 22*g*, moving the projecting portion 11 out from the rear side of the elevated portion 21 (in the drawing, the lower side). When the projecting portion is up on the sloping portion 22*h*, the cam plate is at the leftmost position, allowing the projecting portion to pass and return to the receiving portion 22*a* (FIG. 19). When the projecting portion 11 leaves the upper surface of the cam plate the cam plate returns to the center part of the top surface of the engaging piece, and is ready for the next locking operation.

With the construction of the lock device according to the present invention as described in the above, when the engaging member provided on the door is held, the projecting portion 11 in sliding engagement with the passage, 22 of the cam plate 5 is always in a set position irrespective of its relationship with the passage 22 provided to follow the abbreviated heart form; that is, at the tip of the spring 10 and engaging with the engaging portion 23 while sequentially negotiating the sloping portions and steps of the passage, entering the locked state, and with a second push on the engaging member, moving the engaging piece 2 and the cam plate 5 towards the back of the case, it disengages from the engaging portion 23, advances in the one direction past the sloping portions and steps of the passage to return to the beginning of the passage, unlocking the device. In the course of this, the spring 10 allows only vertical movement of the projecting portion 11 so it moves precisely over the the sequence of sloping portions and steps in the passage, advancing only in the one direction. The lateral widening of the passage 22 in accordance with the heart shape thereof is absorbed by the lateral movement of the cam plate 5 the ridge 20 of which is in sliding engagement with the guide groove 19, so the projecting portion 11 only needs to move vertically.

In accordance with the present invention, because the projecting portion 11 in sliding engagement with the heart-shaped passage 22 only needs to move vertically it can be directly attached to the flat spring 10 provided on the case 1, which facilitates the molding, in addition to which, while the cam plate 5 which takes the projecting portion 11 may be slightly complex in structure, it can be formed of extruded plastic and as such is suited to mass-production, so the manufacture is extremely easy and compared with the above-described conventional types has the advantage of lower cost.

The case 1, engaging piece 2, cam plate 5, and the spring 4 of the device of this invention are, of course, manufactured separately, but as already explained, assembly is very simple and straightforwards, involving only the mounting of the cam plate 5 on the upper surface of the engaging piece 2 and the insertion of the engaging piece into the case opening 6 so it comes between the spring 4 and the case 1.

Also, the cam plate 5 which forms the passage 22 and is like a truncated slab is assembled in contact with the upper surface of the engaging piece 2 and the projecting portion 11 in sliding engagement with this passage is provided directly on a spring 4 formed by cutting out a portion of the wall of the case 1 and as such does not take up much space, enabling the overall device to be made smaller, and therefore can be very effectively implemented as a locking device for doors on articles of furniture, electrical appliance cabinets, and the like.

In addition, in the locking and unlocking operations of the lock device of this invention, the only movements involved are the sliding motion of the engaging piece in the case, the lateral motion of the cam plate 5 and the up and down motion of the projecting portion as it moves along the passage, all of which are simple actions gving little room for errors to occur, so the lock device provides constant stability of function, operating correctly and with little risk of malfunction or damage.

Furthermore, in operation the projecting portion moving along the passage follows the contours of the floor of the passage, and when engaging with or disengaging from the engaging portion the pressure of the spring causes it to produce a distinct click, providing tactile confirmation of the operation.

Also, the case of the device is integrally provided with rims and catch portions and therefore only requires pushing to fit it into place, making it that much more convenient to use.

What is claimed is:

1. A lock device which is locked by a first push and unlocked by a second push comprising: a case open at one end and provided with a spring formed in one face, said spring having on its tip an inward-facing projecting portion; a slidable engaging piece housed in the case, said engaging piece being provided with a transverse guide groove; a spring which constantly urges said engaging piece towards the opening of the case; and a cam plate interposed between the engaging piece and the wall of the case, one face of said cam plate being provided with a ridge which slidably engages with said transverse guide groove of the engaging piece and the other face being provided with a one-way passage loop in which said projection engages; a first push of the engaging piece moving said projecting portion along said one-way passage loop and the cam plate laterally along the guide groove, guiding the projecting portion into engagement with an engaging portion provided partway along said passage, putting the device into the locked state, and a second push disengaging the projecting portion from said engaging portion and transversely returning the cam plate, putting the device into the unlocked state.

* * * * *